United States Patent [19]

Nicholls et al.

[11] 4,002,415

[45] Jan. 11, 1977

[54] DISTRIBUTOR TYPE FUEL INJECTION PUMPS

[75] Inventors: Wilfrid Edward Walter Nicholls, East Molesey; Paul Lakra, Wembley, both of England

[73] Assignee: C.A.V. Limited, Birmingham, England

[22] Filed: Aug. 4, 1975

[21] Appl. No.: 601,432

[30] Foreign Application Priority Data

Aug. 13, 1974 United Kingdom ..... 35578/74

[52] U.S. Cl. ..... 417/245; 123/139 R; 417/462

[51] Int. Cl.[2] ..... F04B 25/00

[58] Field of Search ..... 417/462, 244, 245, 254; 123/139 AM, 139 R

[56] References Cited

UNITED STATES PATENTS

| | | | |
|---|---|---|---|
| 3,439,621 | 4/1969 | Drori | 417/245 X |
| 3,498,226 | 3/1970 | Mowbray | 417/245 X |
| 3,516,395 | 6/1970 | Bassot et al. | 123/139 AM |
| 3,536,421 | 10/1970 | Kemp | 417/294 X |
| 3,822,679 | 7/1974 | Hobo et al. | 123/139 E |
| 3,861,833 | 1/1975 | Salzgeber et al. | 417/462 X |
| 3,919,989 | 11/1975 | Jarret et al. | 123/139 R |

*Primary Examiner*—William L. Freeh
*Assistant Exdminer*—Edward Look

[57] ABSTRACT

A distributor type fuel injection pump includes an injection pump to which fuel is supplied from one end of a bore accommodating a slidable shuttle. The shuttle is moved towards the one end of the bore during the filling strokes of the injection pump by way of a first valve means and is allowed to move away from said one end of the bore during an interval between the filling strokes of the injection pump by fuel under pressure derived from the outlet of a feed pump by way of a second valve means. An electrically operable valve is provided to limit the amount of fuel which can flow from said other end of the bore and a sensor is provided to detect the position of the shuttle within the bore and which by way of a control circuit actuates said electrically operable valve. A third valve means is provided to admit fluid under pressure to said other end of the bore when it is required to fill the injection pump.

12 Claims, 3 Drawing Figures

DISTRIBUTOR TYPE FUEL INJECTION PUMPS

This invention relates to distributor type fuel injection pumps of the kind comprising a rotary distributor member adapted to be driven in timed relationship with an engine with which the apparatus is associated, an injection pump also adapted to be driven in timed relationship with the associated engine and having a pumping chamber communicating with a delivery passage in the distributor member, said delivery passage registering in turn during successive delivery strokes of the injection pump with a plurality of outlet ports in a body containing the distributor member, first valve means through which fuel can flow to the injection pump during the filling strokes thereof, and means for controlling the amount of fuel supplied to said injection pump during the filling strokes.

The object of the invention is to provide such a pump in a simple and convenient form.

According to the invention, in a pump of the kind specified, said means comprises a shuttle movable axially in a bore, one end of said bore being connectible through said first valve means to said pumping chamber, second valve means operable to place said one end of the bore in communication with a source of fuel under pressure, an electrically operable valve for allowing liquid to escape from the other end of said bore during at least part of the time said one end of the bore is in communication with said source of fuel, third valve means operable to connect said other end of the bore to a source of fluid pressure, and control circuit means including a sensor for sensing the position of the shuttle during the time said electrically operable valve is open, and for effecting closure of said valve when the shuttle has moved the required amount away from said one end of the bore, the fuel contained in said one end of the bore being delivered to the jection pump at the next illing stroke thereof.

Examples of fuel injection pump in accordance with the invention will now be described with reference to the accompanying drawing, in which.

Figure 1:
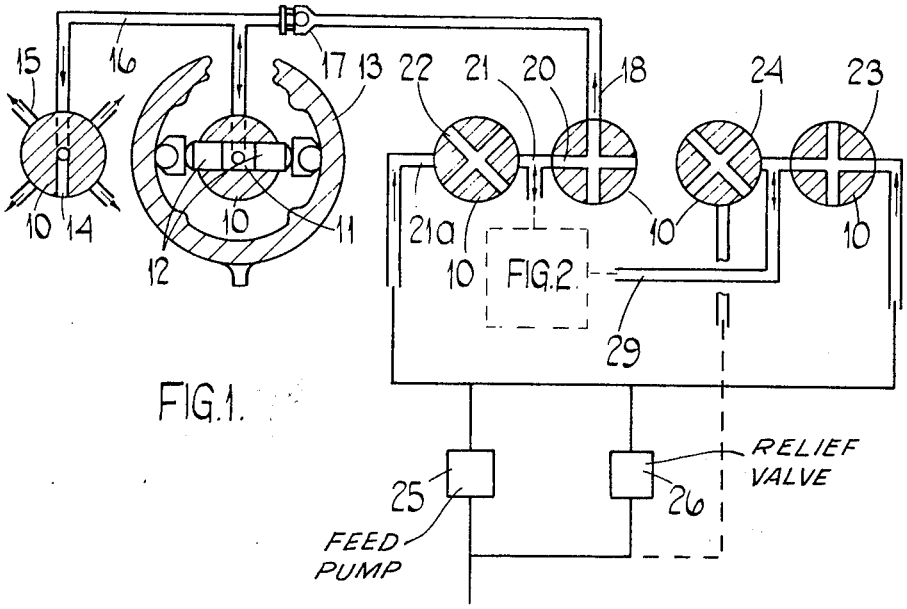
FIG. 1 shows in diagrammatic form, part of the pump.
Figure 2:
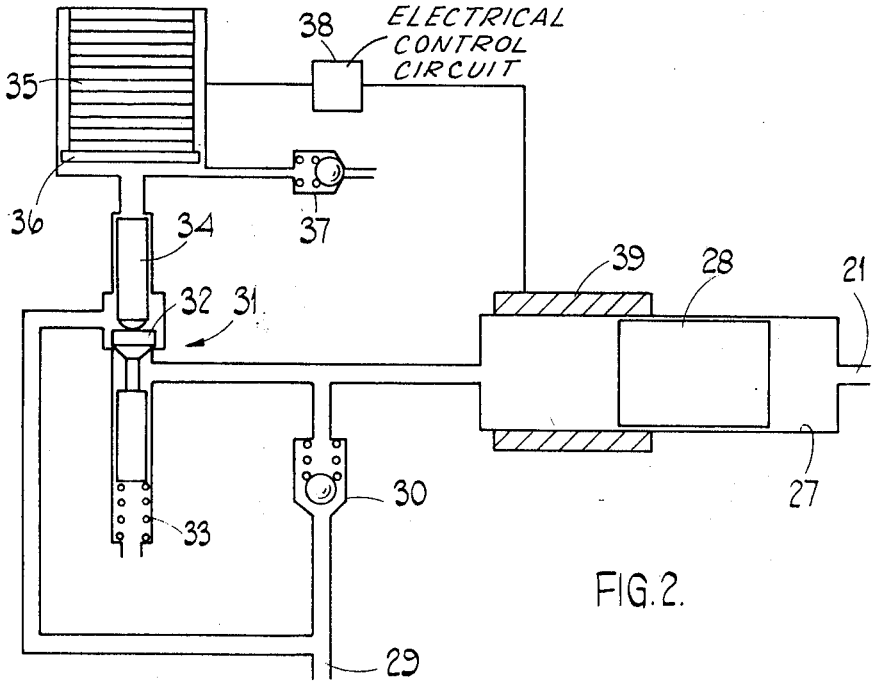
FIG. 2 shows in detail, one example of the portion of the pump of FIG. 1 which falls within the labelled box and, FIG. 3 is a view similar to FIG. 2 showing a modification.

Referring to the FIGS. 1 and 2 of the drawings, there is provided a rotary cylindrical distributor member 10 which is housed within a surrounding body part not shown. The distributor member 10 is shown in the drawing, in six parts and is adapted to be driven in timed relationship with the engine with which the pump is associated. Also provided is an injection pump which comprises a transversely extending bore 11 formed in the distributor member and which accommodates a pair of reciprocable pumping plungers 12. The plungers are adapted to be moved inwardly as the distributor member rotates by cam lobes formed on the internal periphery of an annular cam ring 13. The pumping chamber of the injection pump communicates by way of a passage 16 formed in the distributor member, with a delivery passage 14 extending to the periphery of the distributor member and adapted to register in turn, and during successive injection strokes on the injection pump, with a plurality of outlet ports 15 formed in the body part of the pump. The outlet ports in use, are connected to fuel injection nozzles respectively mounted on the engine.

Fuel is supplied to the injection pump by way of a non-return valve 17, through a passage 18 which is formed in the distributor member and which communicates with, in the particular example, four radially disposed inlet passages indicated at 20. The inlet passages 20 register in turn with a port 21 through which a predetermined quantity of fuel can flow to the injection pump during the filling strokes thereof. The port 21 as is seen in FIG. 2, communicates with one end of bore 27 which contains an axially movable shuttle 28. The port 21 can also be brought into register during the time when the passages 20 are out of register therewith, with passages 22 also formed in the distributor member and which at the same time as they register with the port 21, also register with a further port 21*a* which is in communication with the outlet of a feed pump 25 which supplies fuel under pressure from a source not shown. The outlet pressure of the feed pump is controlled by a relief valve 26. Also provided on the distributor member 10, are a pair of valve means 23, 24 which bring a passage 29 into communication with the outlet of the feed pump or with the inlet of the feed pump as the distributor rotates. The valve 23 is placed in communication with the passage 29, during the time when the port 21 is brought into communication with a passage 20.

The other end of the bore 27 communicates with the passage 29 by way of a non-return valve 30, and in parallel with the non-return valve is an electrically operable valve 31 which includes a spring loaded valve element 32 biassed to the open position by means of a spring 33. The valve element 32 is movable onto its seating by means of a fluid pressure operable piston 34, and the pressure for operating the piston 34 is developed by a stack 35 of piezo-electric crystals which effect movement when they are energised, of a piston 36. A space intermediate the pistons 34, and 36 communicates by way of a non-return valve 37, with the outlet of the feed pump whereby the space between the two pistons is maintained completely full of fuel.

The stack 35 of crystals can be energised by means of an electrical control circuit 38 which also receives a signal from a winding 39 within which the shuttle 28 passes as it is moved in the bore 27.

As shown, the port 21 is in communication with the pumping chamber of the injection pump, and the passage 29 is in communication with the outlet of the feed pump. Fuel therefore is flowing past the non-return valve 30 into the other end of the bore 27 and the shuttle 28 is moving towards said one end of the bore. The valve element 32 of the valve 31 is closed upon its seating. When the shuttle 28 reaches the end of the bore, the predetermined volume of fuel contained in said one end of the bore, has been displaced to the injection pump, and during continued rotation of the distributor member, the passage 14 will be brought into register with an outlet port 15 and the fuel will be delivered to the respective engine cylinder. Moreover, the port 21 will be placed in communication by way of a passage 22, with the outlet of the feed pump and the passage 29, with the inlet of the feed pump. Previously the stack of crystals 35 has been de-energised so that the valve 32 is lifted from its seating. Fuel can therefore flow from the outlet of the feed pump into said one end of the bore 27 to displace the shuttle towards the other end of the bore. During this movement, the fuel from said other end of the bore escapes by way of the valve 31, the valve 30 being in the closed condition. The position of the shuttle 28 is sensed by the coil 39, and when the desired displacement of the shuttle has occured, this fact is sensed and the stack 35 of crystals is energised to cause displacement of the piston 36 and hence the piston 34, the latter moving the valve element 32 onto its seating to prevent further flow of fuel from said other end of the bore. Since fuel can now no longer escape from the bore, the movement of the shuttle 28 is halted, and this condition remains until the injection stroke of the injection pump has finished, and the distributor has moved so that the various ports and passages are in the position shown in FIG. 1. When this occurs, the valve 30 is opened by the outlet pressure of the feed pump and the shuttle 28 moves towards said one end of the bore. The stack of crystals 35 can be de-energised so that the valve 31 is opened as the shuttle approaches the end of the bore.

The end of the valve element 32 against which the spring 33 bears is formed as a piston and is subjected to the outlet pressure of the feed pump by way of a passage not shown. This has the effect of ensuring that the valve element is substantially pressure balanced during the time that the passage 29 is in communication with the outlet of the feed pump.

The stack 35 of crystals may be replaced by an electro-magnet means effecting movement of the valve element 32 directly. If desired and particularly where the stack of crystals is replaced by an electro-magnet, the valve element may be in the form of a spool.

Figure 3:
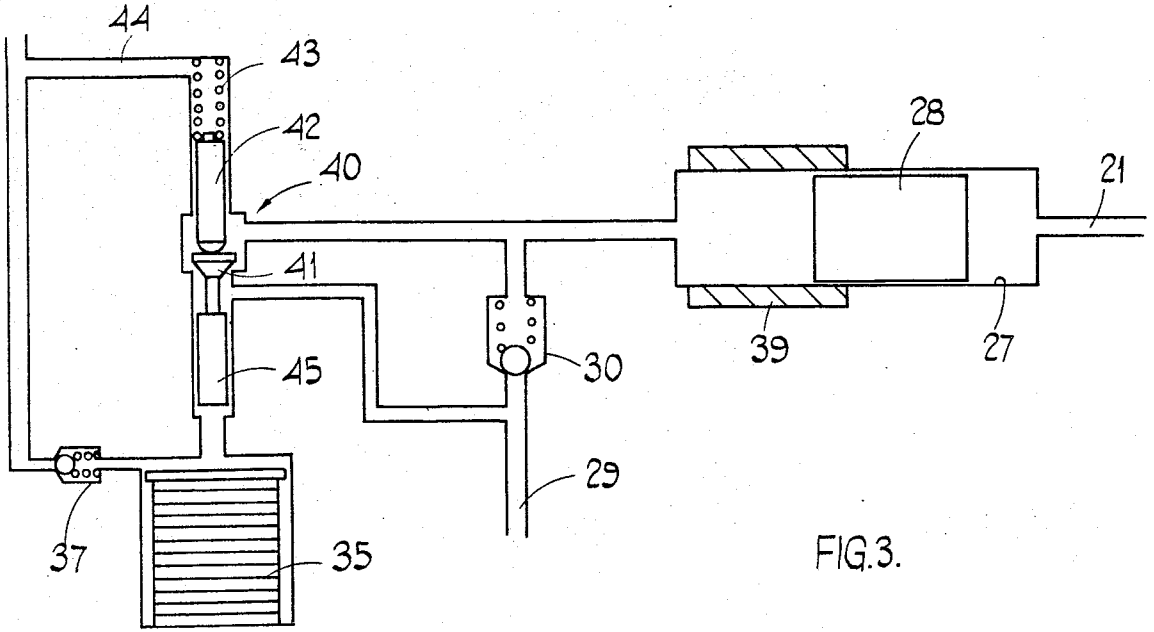

In the arrangement shown in FIG. 3 like reference numerals to those of FIG. 2 are used when the parts perform the same function. The valve 31 is replaced by a valve 40 and this comprises a valve element 41 which is loaded by means of a piston 42 onto a seating. The piston 42 is loaded by a coiled compression spring 43 and is also connected by a passage 44 to the outlet of the feed pump 25.

Moreover, the valve element includes an integral piston portion 45 which can be subjected to the pressure generated upon energisation of the stack 35 of crystals to move the valve element and piston 42 against the action of the spring 33 and the outlet pressure of the feed pump. A space defined between the valve element 41 and the piston portion 45 communicates with the passage 29 and a space surrounding the end of the piston 42 remote from the spring communicates with said other end of the bore 27. In operation, the stack 35 of crystals must be energised to allow fuel to flow from said one end of the bore, otherwise the mode of operation is the same as the arrangement of FIG. 2. The arrangement of FIG. 3 has the advantage over the arrangement of FIG. 2 in that if the control circuit should fail so that the stack of crystals is not energised, then the supply of fuel by the pump will cease. In the case of the example of FIG. 2 under this condition the pump would supply maximum fuel to the engine.

As with the arrangement of FIG. 2, the arrangement of FIG. 3 may be modified by the use of an electro-magnet to operate the valve element directly instead of the stack of crystals. Furthermore, the valve element may comprise a spool.

We claim:

1. A distributor type fuel injection apparatus comprising a body, a rotary distributor member located in the body, an injection pump including a pumping chamber in which is located a reciprocable pump plunger, cam means for imparting movement to the plunger to displace fuel from said pumping chamber, a delivery passage in said distributor member in communication with said pumping chamber, a plurality of outlet ports in said body and with which said delivery passage registers in turn during successive delivery strokes of the injection pump, a source of fuel under pressure, first valve means through which fuel can flow to the injection pump during the filling strokes thereof and means for controlling the amount of fuel supplied to the injection pump during the filling strokes, said means including a shuttle movable axially in a bore, one end of said bore being connectible through said first valve means to said pumping chamber, second valve means operable to place said one end of the bore in communication with said source of fuel, an electrically operable valve for allowing fuel to escape from the other end of said bore during at least part of the time said one end of the bore is in communication with said source of fuel, third valve means operable to connect said other end of the bore to said source of fuel, and control circuit means including a sensor for sensing the position of the shuttle during the time said electrically operable valve is open, and for effecting closure of said electrically operable valve when the shuttle has moved the required amount away from said one end of the bore, the fuel contained in said one end of the bore being delivered to the injection pump at the next filling stroke thereof.

2. An apparatus as claimed in claim 1 in which said third valve means is formed in part by the distributor member.

3. An apparatus as claimed in claim 2 including a non-return valve in circuit with said third valve means and said other end of the bore, said non-return valve opening to permit flow of fuel to said other end of the bore when said third valve means has opened.

4. An apparatus as claimed in claim 3 in which the fuel displaced from said other end of the bore flows by way of said electrically operable valve.

5. An apparatus as claimed in claim 4 including fourth valve means formed in part by the distributor member, said fourth valve means being connected to said other end of the bore by way of said electrically operable valve.

6. An apparatus as claimed in claim 1 in which said electrically operable valve includes a valve element, and a stack of piezo-electric crystals for actuating said valve element, said control circuit controlling the energisation of said crystals.

7. An apparatus as claimed in claim 6 including a cylinder and a piston in the cylinder operable by said crystals to displace fluid and piston means operable by the displacement of said fluid for actuating the valve element of said electrically operable valve.

8. An apparatus as claimed in claim 7 including a spring loading said valve element towards an open position, said valve element being moved to the closed position by the fluid pressure developed by movement of said piston by said stack of crystals.

9. An apparatus as claimed in claim 7 including a spring loading said valve element towards the closed position, said valve element being moved to the open position by the fluid pressure developed by movement of said piston by said stack of crystals.

10. An apparatus as claimed in claim 6 in which said valve element comprises a spool.

11. An apparatus as claimed in claim 1 in which said electrically operable valve includes a valve element and electromagnetic means for actuating the valve element.

12. An apparatus as claimed in claim 11 in which said valve element comprises a spool.

* * * * *